US009341006B1

(12) United States Patent
Lawrence

(10) Patent No.: US 9,341,006 B1
(45) Date of Patent: May 17, 2016

(54) LOCK WITH HIDDEN FASTENERS AND METHOD

(71) Applicant: Barry G. Lawrence, Thomasville, NC (US)

(72) Inventor: Barry G. Lawrence, Thomasville, NC (US)

( * ) Notice: Subject to any disclaimer, the term of this patent is extended or adjusted under 35 U.S.C. 154(b) by 83 days.

(21) Appl. No.: 14/136,659

(22) Filed: Dec. 20, 2013

(51) Int. Cl.

| | |
|---|---|
| ***E05C 3/04*** | (2006.01) |
| ***E05B 9/02*** | (2006.01) |
| ***E05B 9/08*** | (2006.01) |
| ***E05B 65/08*** | (2006.01) |
| *E05C 3/02* | (2006.01) |

(52) U.S. Cl.
CPC . *E05C 3/046* (2013.01); *E05B 9/02* (2013.01); *E05B 9/082* (2013.01); *E05B 65/0841* (2013.01); *E05C 3/04* (2013.01)

(58) Field of Classification Search
CPC ..... E05F 2700/04; E05C 2007/007; E05C 3/046; E05C 3/004; E05C 3/02; E05C 3/04; E05C 3/041; E05C 3/043; E05C 3/044; E05C 3/045; E05C 3/06; E05C 3/10; E05C 3/12; E05C 3/14; E05C 3/145; E05C 7/02; E05B 65/0025; E05B 65/08; E05B 65/0841; E05B 65/0811; E05B 65/0829; E05B 65/0835; E05B 9/02; E05B 9/082
USPC ..... 292/DIG. 20, DIG. 47, 194, 195, 200, 292/202, 210, 240, 241, 337, DIG. 27, 292/DIG. 35, DIG. 39, DIG. 49, DIG. 53, 292/DIG. 64; 70/89, 90; 49/449
See application file for complete search history.

(56) References Cited

U.S. PATENT DOCUMENTS

| | | | | |
|---|---|---|---|---|
| 1,503,393 | A * | 7/1924 | Twardowsky | 292/241 |
| 5,454,609 | A | 10/1995 | Slocomb et al. | 292/337 |
| 6,116,665 | A * | 9/2000 | Subliskey | 292/241 |
| 6,634,683 | B1 | 10/2003 | Brannan | 292/241 |
| 7,407,199 | B2 * | 8/2008 | Richardson | 292/163 |
| 7,676,990 | B2 * | 3/2010 | Bestler et al. | 49/449 |
| 8,870,244 | B2 * | 10/2014 | Liang et al. | 292/173 |
| 9,157,254 | B1 * | 10/2015 | Rogers | E05B 9/02 |
| 2008/0169658 | A1 * | 7/2008 | Wolf | 292/241 |
| 2009/0179436 | A1 * | 7/2009 | Sagalara et al. | 292/174 |
| 2010/0207403 | A1 * | 8/2010 | Bourgoin et al. | 292/335 |
| 2011/0304163 | A1 * | 12/2011 | Liang et al. | 292/242 |
| 2012/0284993 | A1 * | 11/2012 | Liang et al. | 29/453 |

* cited by examiner

*Primary Examiner* — Alyson M Merlino
(74) *Attorney, Agent, or Firm* — Blake P. Hurt; Tuggle Duggins P.A.

(57) ABSTRACT

A polymeric sash lock including a housing slideably received by a base, the housing defining a pair of rail channels and a cam positioned within the housing. A pair of rails are opposingly mounted on the base for engaging separate rail channels. The base also includes first and second resilient ears mounted in opposing relation along the base for frictionally engaging said housing. A method of locking a window sash is also provided.

15 Claims, 4 Drawing Sheets

LOCK WITH HIDDEN FASTENERS AND METHOD

FIELD OF THE INVENTION

The invention herein pertains to window hardware and particularly pertains to a window sash lock that is engaged to a lock base that receives fasteners, presenting a window sash lock without visible fasteners.

DESCRIPTION OF THE PRIOR ART AND OBJECTIVES OF THE INVENTION

Window locks with concealed hardware have become increasingly popular due to their aesthetically pleasing appearance and increased structural stability when combined with an associated base. During installation, window fasteners such as screws and the like are used to attach window hardware such as locks, latches, and keepers to the rail of a single or double hung window. In addition to being unsightly, installation in this manner can cause a number of problems for the installed hardware. For example, unless the fasteners are tightened with precision at the same rate and for the same duration, variations in the hardware positioning and alignment may occur. These alternations may lead to failure of engagement between the lock and the keeper, raising questions as to the safety and security provided by the window.

One solution to providing increased safety and structural stability to the window rail and any attached hardware is to use a lock base to receive both the hardware fasteners and the lock. A base can be affixed to the window rail and then engage the body of the window lock, permitting a better opportunity for correct alignment. However, many bases fail to adequately secure the associated lock thereto, leading to fasteners connecting a lock to a base in addition to a window rail.

Thus, in view of the problems and disadvantages associated with prior art window hardware, the present invention was conceived and one of its objectives is to provide a window sash lock with concealed fasteners.

It is another objective of the present invention to provide a sash lock defining a pair of opposing rail channels on the underside of the lock housing.

It is still another objective of the present invention to provide a sash lock with a base that engages the sash lock housing.

It is yet another objective of the present invention to provide a sash lock base with a pair of opposing T-shaped rails for engaging corresponding rail channels defined by the lock housing.

It is a further objective of the present invention to provide a sash lock base that defines a resilient ear on opposing ends of the base that frictionally engage the lock housing upon insertion.

It is still a further objective of the present invention to provide a sash lock base with rails that define a plurality of apertures, the apertures sized to receive fastener hardware.

It is yet a further objective of the present invention to provide a sash lock base with an ear that is vertically biased relative to the remainder of the base.

It is another objective of the present invention to provide a method of concealing window lock fastener hardware, installing a sash lock base for receiving the hardware, and then concealing that base with a lock housing.

It is yet a further objective of the present invention to provide a method of securing a sash lock base to a sash lock housing by engaging a plurality of vertically biased ears on the base with the housing.

Various other objectives and advantages of the present invention will become apparent to those skilled in the art as a more detailed description is set forth below.

SUMMARY OF THE INVENTION

The aforesaid and other objectives are realized by providing a polymeric window sash lock including a housing containing a sloping cam connected by an axle to a lock handle. The housing defines a pair of opposing rail channels with an open end for securing the housing to a lock base. The lock base includes a pair of opposing T-shaped rails that correspond in length, width, and height for insertion into different ones of the rail channels. The rails each define a plurality of apertures sized to receive fastener hardware, such that when the base is installed, the pair of rails engage the pair of channels and all fastener hardware is concealed. The lock base also includes a pair of resilient ears vertically biased relative to the base and positioned on opposing sides of the base. These ears frictionally engage the lock housing upon engagement of the rails with the rail channels, and the housing may be removed from the lock base by depressing the biased ears. A method of using the window lock is also provided.

DETAILED DESCRIPTION OF THE PREFERRED EMBODIMENT AND OPERATION OF THE INVENTION

Figure 1:
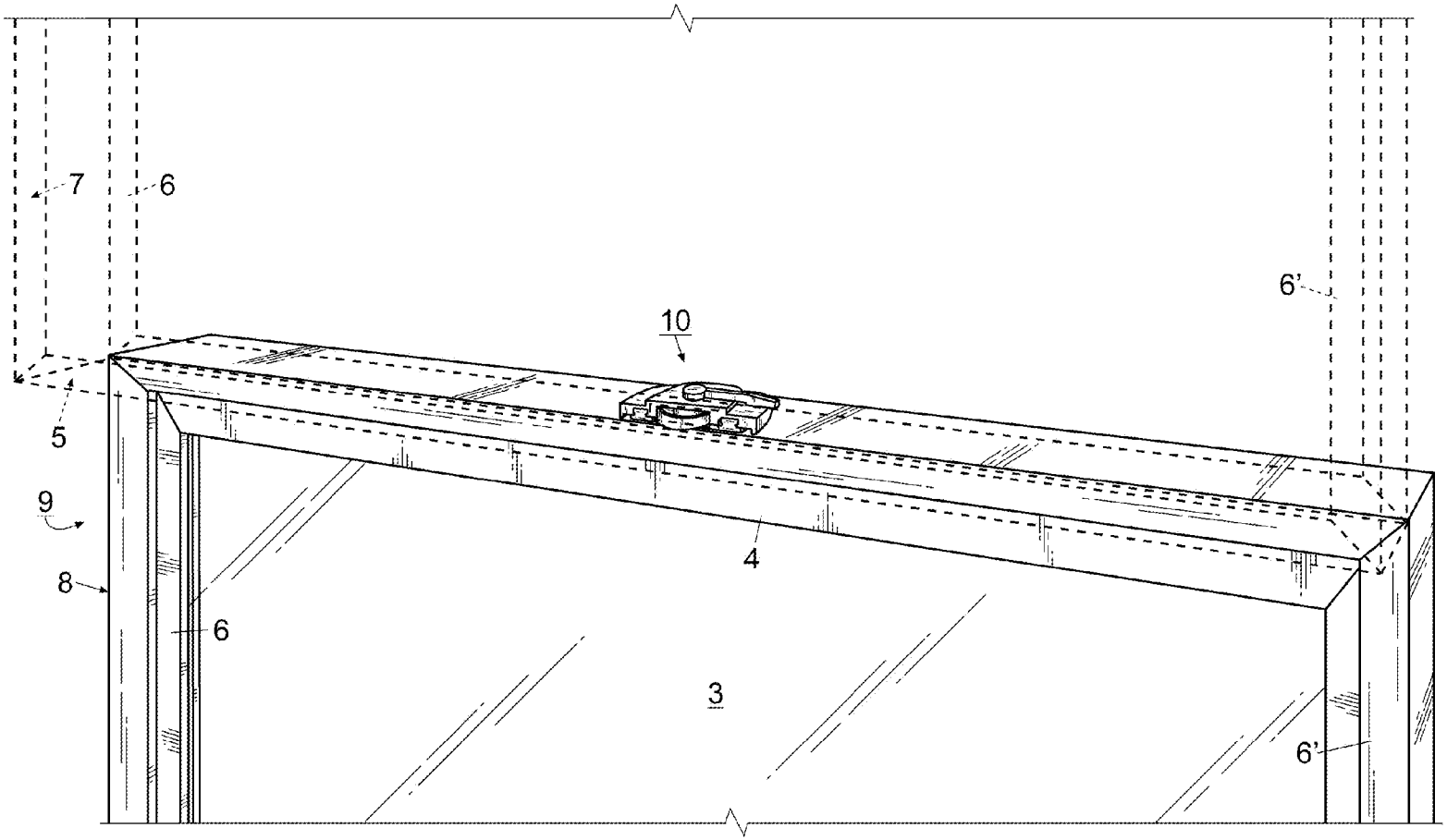
FIG. 1 shows an exterior perspective view of a window sash lock with hidden fasteners as installed on a lower sash of a double-hung window.

For a better understanding of the invention and its operation, turning now to the drawings, preferred sash lock 10 is shown in FIGS. 1-8. Double-hung window 9 as partially shown in FIG. 1 may be formed from upper and lower sashes 7, 8 which are each respectively defined by a pair of side stiles 6, 6' affixed at opposing longitudinal ends to base rail 5 and header rail 4. Upper and lower sashes 7, 8 are thus each configured to retain glass pane 3 therein, for example in a rectangular shape as is conventional. Sash lock 10 may be positioned atop header rail 4 of lower sash 8 to engage a corresponding keeper (not shown) positioned on base rail 5 of upper sash 7 as is known in the art. While sash lock 10 and the corresponding keeper may be positioned anywhere on respective header and base rails 4, 5, preferred sash lock 10 and the keeper are oriented proximate the center of respective rails 4, 5 to evenly resist displacement forces such as inclement weather or unauthorized entry. Sash lock 10 may be formed from any suitable material capable of resisting breaking or torsional forces imparted on window 9, but preferably is formed from nylon or a similar polymeric substance.

Figure 2:
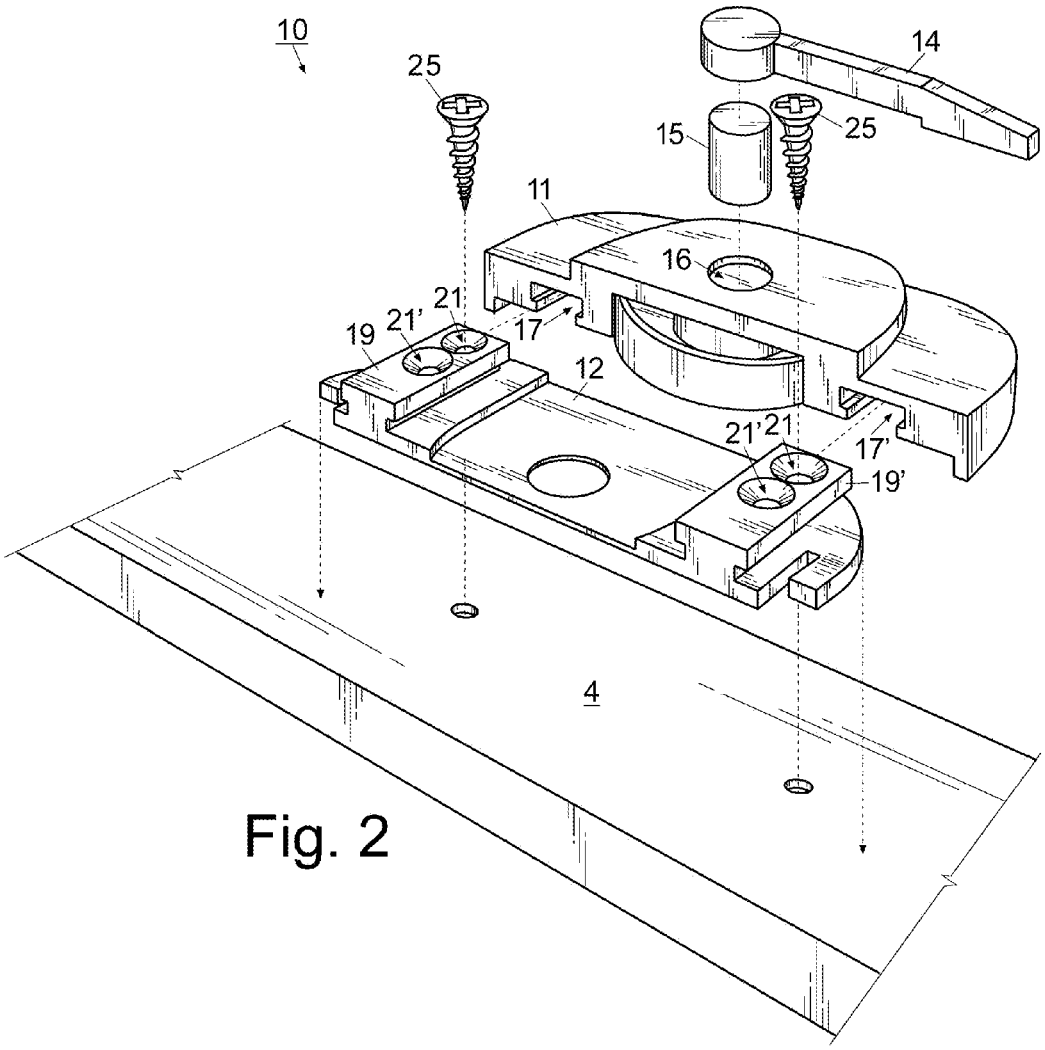
FIG. 2 pictures an enlarged, exploded perspective view of the components of the sash lock as shown in FIG. 1.

FIG. 2 pictures an enlarged perspective view of lock 10 with various components exploded therefrom. Sash lock 10 includes lock housing 11 and lock base 12. Housing 11 contains gradually sloping cam 13 (FIGS. 3, 4) that is in rotational communication with handle 14 via axle 15. Housing 11 defines a circular aperture 16 in the top surface sized to receive cylindrical axle 15 therethrough, such that when handle 14 is rotated, for example when urged by a user, cam 13 correspondingly rotates to engage or disengage an associated keeper as conventional. It should be noted that although handle 14 and axle 15 are shown as independent components, handle 14 and axle 15 may be integrally formed such that they are a single structure.

Figure 4:
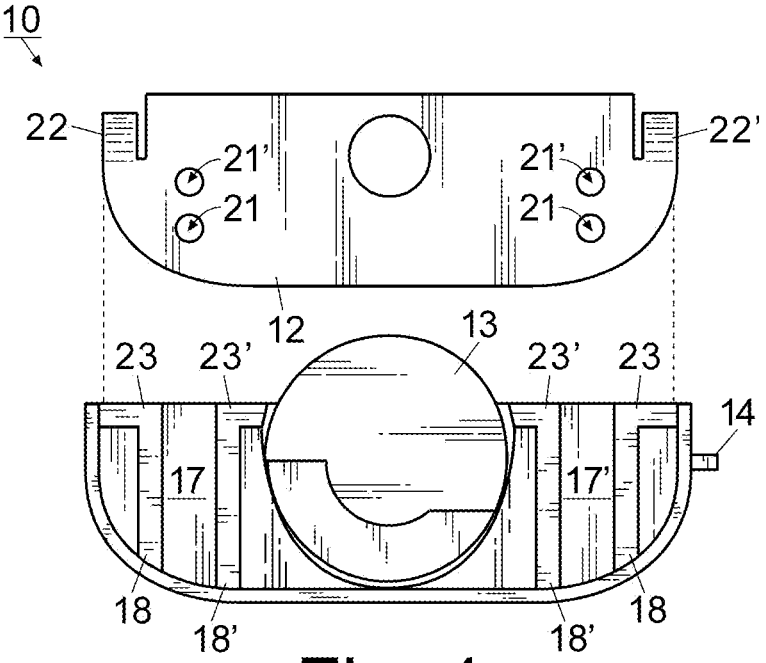
FIG. 4 demonstrates an exploded, bottom plan view of the window lock as shown in FIG. 3.
Figure 5:
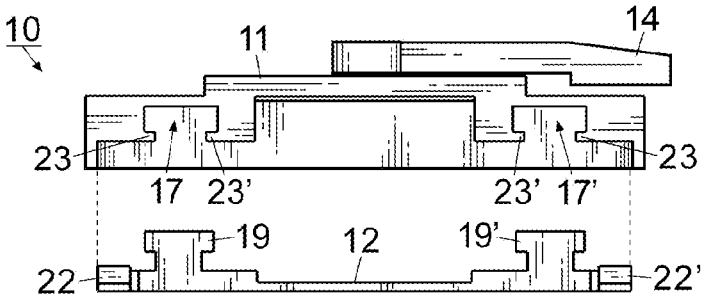
FIG. 5 illustrates an exploded, rear elevational view of the window lock.
Figure 6:
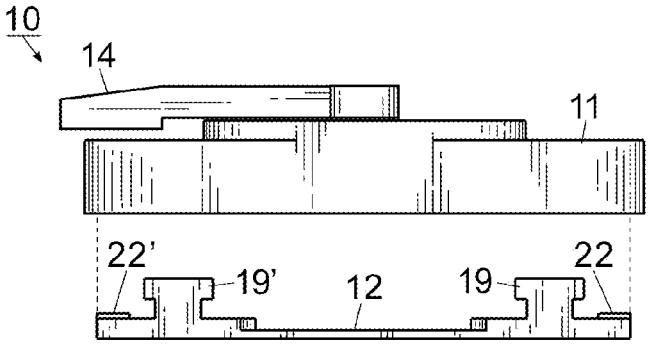
FIG. 6 features an exploded, front elevational view of the window lock as shown in FIG. 5.

Housing 11 preferably defines a pair of T-shaped rail channels 17, 17' in the bottom surface thereof. Each rail channel includes a pair of opposing L-shaped sides 18, 18' as seen in FIG. 4 that extend inwardly at the bottom each forming respective shoulders 23, 23' (FIG. 5) to engage respectively T-shaped rails 19, 19' attached to lock base 12 (FIG. 6). The length, width, and depth of rail channels 17, 17' correspond to the length, width, and height of rails 19, 19' such that when rails 19, 19' are inserted into rail channels 17, 17' respectively, there is no lateral or longitudinal overhang between lock base 12 and housing 11. Although the T-shape of rails 19, 19' and rail channels 17, 17' are preferred, nothing in this disclosure should be construed as limiting the shapes of the rails and channels. Other configurations such as regular polygons, irregular polygons, and arcuate shapes are also contemplated in the instant invention.

Preferred lock base 12 defines a central clearance opening and pair of opposing T-shaped rails 19, 19' that in turn define a plurality of fastener apertures 21, 21'. Apertures 21, 21' may be countersunk into the surface of rails 19, 19' and are sized to receive fasteners 25 such that the heads of fasteners 25 are below or flush with the top surface of rails 19, 19' to prevent obstruction from base 12 slideably receiving housing 11 thereover. Fasteners 25 are represented in FIG. 2 as screws that widen in diameter as the screw head is approached, but it should be understood that any appropriate fastener hardware may be used to affix lock base 12 to header rail 4. Further, although only a pair of fasteners 25 are shown, any number of fasteners may be utilized with apertures 21, 21' to sufficiently position and maintain lock base 12 on header rail 4.

Figure 7:
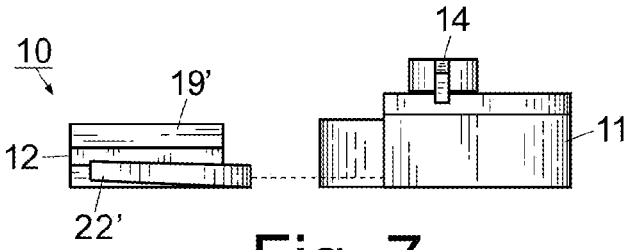
FIG. 7 shows an exploded, right side elevational view of the window lock as shown in FIG. 3.
Figure 8:
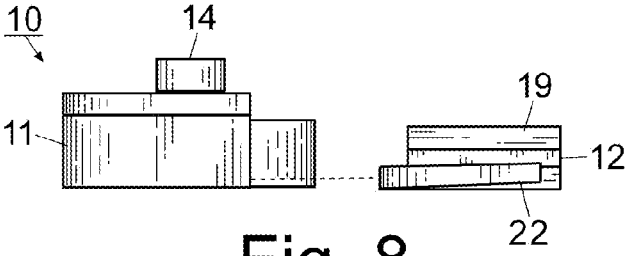
FIG. 8 illustrates an exploded, left side elevational view of the window lock as shown in FIG. 7.

Preferred lock base 12 also defines a pair of resilient ears 22, 22' positioned on opposing sides of lock base 12 as shown in FIGS. 3, 4, 7, and 8. Ears 22, 22' are resilient, in that when depressed, for example when frictionally engaging lock housing 11 as rail channels 17, 17' receive respective rails 19, 19', ears 22, 22' return to their upwardly biased orientation as seen in FIGS. 7 and 8 relative to base 12. Ears 22, 22' preferably define a six degree (6°) angle relative to base 12, which allows shoulders 23 defined by housing 11 to pass over and flex ears 22, 22' downward without excessive frictional engagement but also permits ears 22, 22' to engage respective shoulders 23 upon frictional release following installation. While six degrees (6°) is preferred, any angle that satisfies the above criteria, for example three degrees to thirty degrees (3°-30°), is contemplated in the instant invention. An embodiment of ears 22, 22' may define a protrusion or lip (not shown) for frictionally engaging housing 11 positioned proximate the terminal end. This lip may facilitate easy separation of housing 11 from base 12 by providing a more engageable surface to frictionally engage, for example when ears 22, 22' are manually or mechanically depressed.

Figure 3:
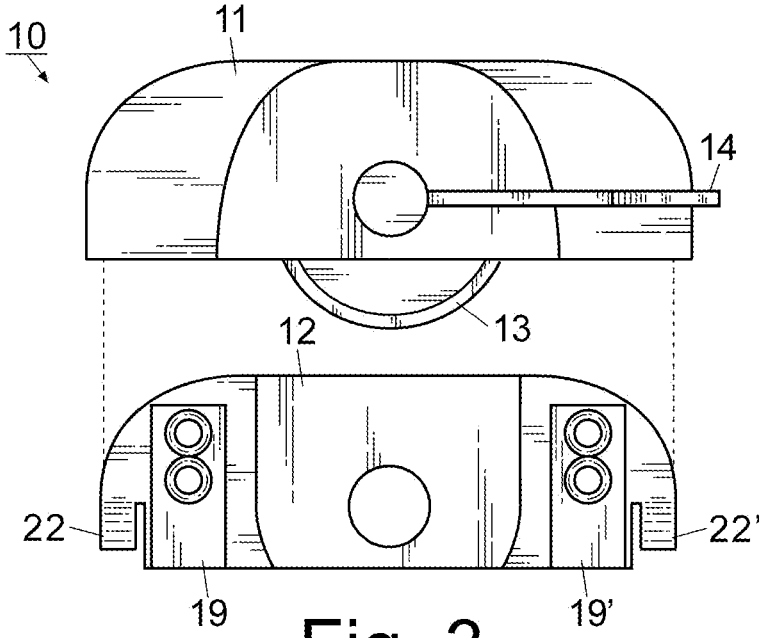
FIG. 3 depicts an exploded, top plan view of the window lock prior to installation.

FIG. 3 depicts a top plan view of housing 11 separated from lock base 12 while FIG. 4 demonstrates a bottom plan view of respective components 11, 12. Rail channels 17, 17' are longitudinally defined by opposing rail sides 18, 18'. As described above, sides 18, 18' define an L-shape, with the horizontally extending short leg projecting into a cavity underneath the "T" of rails 19, 19', shown in the elevational front and rear views in FIGS. 5 and 6.

A method of utilizing sash lock 10 to secure double-hung window 9 includes the step of providing lock housing 11 attached to handle 14 via axle 15 and containing graduated cam 13 therein. Lock base 12 defining a pair of T-shaped rails 19, 19' and resilient ears 22, 22' on opposing ends of base 12 is also provided. Lock base 12 is positioned in the middle of header rail 4, opposite a corresponding keeper on base rail 5, and affixed into position with fasteners 25 which pass through fastener apertures 21, 21' formed in rails 19, 19'. After fasteners 25 are threadably attached to header rail 4, rail channels 17, 17' of housing 11 are aligned to slidably engage respectively corresponding rails 19, 19' of base 12. As housing 11 is slid overtop base 12, rail sides 18 with respective shoulders 23 flex ears 22, 22' downwardly. Once ears 22, 22' are past respective shoulders 23, they return to their upwardly biased orientation as seen in FIGS. 7 and 8, engaging different ones of housing shoulders 23. To remove housing 11 from base 12, ears 22, 22' are depressed as housing 11 is slidably disengaged from base 12.

In an alternate embodiment of sash lock 10, lock base 12 defines a downwardly depending lip on the front edge of the base opposite the keeper (not shown). This lip may be utilized in approximating the final position of sash lock 10 relative to the front and rear edges of header rail 4. This lip thus serves to prevent the misalignment of sash lock 10, whether too near or too distant from the associated keeper. Another alternate embodiment of sash lock 10 includes lock base 12 defining one or more L-shaped feet that may be inserted into predrilled holes in header rail 4 (not shown). By inserting these feet into the holes lock 10 potentially increases the overall structural integrity of window 9 instead of compromising it. The feet extend down and under the rail surface and may be secured in place by either aligned fasteners 25 or additional screws that prevent the feet from inadvertent displacement or removal, for example in environments where linearly aligned fasteners alone are insufficient to maintain the mount of lock 10. Yet another embodiment of lock 10 includes lock base 12 defining one or more studs protruding from the underside of the base (not shown). These studs may be aligned with and inserted into apertures formed in a mounting surface, for example header rail 5. In addition to providing addition structural and torsional support to lock 10, these studs may prevent displacement of lock 10 during installation, for example if fasteners 25, 25' are inserted using a powered screw gun, drill, or the like. By resisting these torsional forces, lock 10 enjoys an increased likelihood of proper installation and use.

The illustrations and examples provided herein are for explanatory purposes and are not intended to limit the scope of the appended claims.

I claim:

1. A sash lock comprising: a housing, a base defining a first rail having a length defining a longitudinal axis, a first portion that extends perpendicularly from said base, and a second portion that extends perpendicularly relative to said first portion, forming sections that extend perpendicularly beyond opposing sides of said first portion so as to provide said first rail with a T-shaped cross section, wherein said opposing sides of said first portion are parallel to said longitudinal axis of said first rail, said housing defining a first rail channel with opposing L-shaped sides oriented to extend inwardly toward a space defined by said first rail channel to form a pair of shoulders that stretch substantially along a length of said first rail channel, a rotatable cam positioned within said housing and in communication with a handle, said base defining a first resilient ear positioned on the periphery of said base, said ear defining an upwardly biased stance relative to said base, whereby said first rail is slideably received within said space of said first rail channel, and whereby said sections of said second portion of said first rail frictionally engage each of said shoulders of said first rail channel, and whereby said first resilient ear frictionally engages said housing.

2. The sash lock of claim 1 wherein said housing defines a second rail channel with opposing L-shaped sides oriented to extend inwardly toward a space defined by said second rail channel forming a pair of shoulders that stretch along a length of said second rail channel, and said base defines a second rail having a length defining a longitudinal axis, a first portion that extends perpendicularly from said base, and a second portion that extends perpendicularly relative to said first portion, forming sections that extend perpendicularly beyond opposing sides of said first portion so as to provide said second rail with a T-shaped cross section, wherein said opposing sides of said first portion are parallel to said longitudinal axis of said second rail, and wherein said sections of said second portion of said second rail frictionally engage each of said shoulders of said second rail channel when said second rail is slideably received within said space of said second rail channel.

3. The sash lock of claim 2, wherein said base defines a second resilient ear positioned on said base in opposing relation to said first resilient ear.

4. The sash lock of claim 3, wherein said second resilient ear defines an upwardly biased stance relative to said base.

5. The sash lock of claim 1 wherein said first rail defines a conically shaped first opening sized to receive and countersink a threaded member.

6. The sash lock of claim 2 wherein said first rail and said second rail each define a pair of conically shaped openings.

7. A sash lock for locking a first window sash relative to an opposing second window sash, said sash lock engageable with a keeper positioned on the opposing second window sash, the sash lock comprising: a housing defining first and second rail channels, each rail channel extending a substantial width of the housing and formed with opposing L-shaped sides oriented to extend inwardly toward a space defined by said corresponding rail channel and forming respective pairs of shoulders that stretch along the entirety of a length of said respective rail channel, a cam rotatably mounted within said housing and engageable with said keeper; a handle external to said housing and affixed to said cam, said first and second rail channels positioned on either side of said cam; a base; first and second rails mounted on said base, each rail comprising a length defining a longitudinal axis, a first portion that extends perpendicularly from said base, and a second portion that extends perpendicularly relative to said first portion, forming sections that extend perpendicularly beyond opposing sides of said first portion so as to provide each of said first and second rails with a T-shaped cross section, wherein said opposing sides of said first portion are parallel to said longitudinal axis of said respective one of said first and second rails, wherein each of said rail channels receives a corresponding one of said first and second rails, and a pair of resilient ears mounted on the periphery of said base, said ears each defining an upwardly biased stance relative to said base and frictionally engaging said housing when said first and second rails are received within said space of said corresponding one of said first and second rail channels.

8. The sash lock of claim 7 wherein said housing and at least a portion of said shoulders of said first and second rail channels define a pair of guides located on opposing sides of said cam such that each of said resilient ears engages a corresponding one of said guides.

9. The sash lock of claim 7 wherein each of said first and second rails defines a pair of rail openings, and wherein said sash lock further comprises two pairs of threaded members, wherein each threaded member is located in a corresponding one of said rail openings to secure said base to the first window sash.

10. The sash lock of claim 7 further comprising an axle connected to said handle and to said cam.

11. The sash lock of claim 7 wherein said cam extends beyond said housing for engaging the keeper.

12. A method of locking a first window sash relative to an opposing second window sash of a double hung window comprising the steps of: a) providing a window lock having a housing with a pair of rail channels, each rail channel extending a substantial width of the housing and formed with opposing L-shaped sides oriented to extend inwardly toward a space defined by said respective rail channel, said L-shaped sides form respective pairs of shoulders that stretch along the entirety of a length of said each rail channel, a rotatable cam mounted between the rail channels, a pair of ear guides defined by said housing and at least a portion of said shoulders of said rail channels, and a handle attached to the cam; and a base having a pair of rails, each rail having a length defining a longitudinal axis, a first portion that extends perpendicularly from said base, and a second portion that extends perpendicularly relative to said first portion, forming sections that extend perpendicularly beyond opposing sides of said first portion to provide each of said rails with a T-shaped cross section, wherein said opposing sides of said first portion are parallel to said longitudinal axis of said respective rail, each rail having openings for threaded members, and the base further comprising a pair of ears, each defining an upwardly biased stance relative to the base; b) mounting the base onto the first window sash opposite to a keeper on the opposing second window sash; c) sliding the housing onto the base by engaging each pair of rail channels shoulders with a corresponding pair of said sections of said second portions of said rails; and d) rotating the handle cashing the cam to engage the keeper.

13. The method of claim 12 further comprising the step of flexing the ears within the ear guides as the housing is slid onto the base.

14. The sash lock of claim 7 wherein the length of each of the first and second rail channels matches the length defined by each of said first and second rails, whereby an entirety of each of said first and second rails is received within a respective one of the first and second rail channels without any portion of each rail extending beyond the housing when said base is engaged with said housing.

15. The sash lock of claim 7 wherein each of said resilient ears defines a bias relative to said base of approximately six degrees (6°).

* * * * *